US009437957B2

(12) United States Patent
Lee

(10) Patent No.: US 9,437,957 B2
(45) Date of Patent: Sep. 6, 2016

(54) WATERPROOF CONNECTOR HAVING INTERNALLY CONCEALED GROUNDING PIN

(71) Applicant: SIMULA TECHNOLOGY INC., Taoyuan (TW)

(72) Inventor: Yi-Ming Lee, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 14/626,004

(22) Filed: Feb. 19, 2015

(65) Prior Publication Data

US 2016/0164218 A1 Jun. 9, 2016

(30) Foreign Application Priority Data

Dec. 5, 2014 (TW) ..... 103221565 U

(51) Int. Cl.
*H01R 13/40* (2006.01)
*H01R 13/52* (2006.01)

(52) U.S. Cl.
CPC ..... *H01R 13/5202* (2013.01)

(58) Field of Classification Search
CPC ..... H01R 12/716; H01R 13/52; H01R 12/71
USPC ..... 439/587
See application file for complete search history.

(56) References Cited

U.S. PATENT DOCUMENTS 6,623,299 B1 * 9/2003 Liu ..... H01R 13/5845 439/587
7,510,437 B2 * 3/2009 Wu ..... H01R 24/50 439/581
7,922,535 B1 * 4/2011 Jiang ..... H01R 13/5205 439/271
2012/0115337 A1 * 5/2012 Jin ..... H01R 24/50 439/38
2012/0315779 A1 * 12/2012 Yudate ..... H01R 12/724 439/271
2013/0065442 A1 * 3/2013 Nagata ..... H01R 13/5202 439/607.58
2014/0342599 A1 * 11/2014 Zhang ..... H01R 12/724 439/521
2015/0255905 A1 * 9/2015 Little ..... H01R 13/6658 439/78
2015/0255911 A1 * 9/2015 Kato ..... H01R 24/64 439/345

* cited by examiner

*Primary Examiner* — Abdullah Riyami
*Assistant Examiner* — Nader J Alhawamdeh
(74) *Attorney, Agent, or Firm* — Bacon & Thomas, PLLC

(57) ABSTRACT

The present invention is to provide a waterproof connector having internally concealed grounding pin, which includes an outer housing having an isolation layer covered on a metal frame thereof by injection molding to form at least one grounding part exposed to a first accommodating space therein and at least one outer grounding pin exposed out of the isolation layer; an inner casing made of metal material and having at least one inner grounding pin abutted against the grounding part when the inner casing is mounted inside the outer housing; a terminal block formed by plastic integrally, having a plurality of connection terminals passing therethrough, and mounted inside the inner casing; and a waterproof glue layer watertightly filled in the rear ends of the outer housing and inner casing. Since the inner grounding pin is fully concealed inside the outer housing, the moisture can no more pass through the connector accordingly.

8 Claims, 7 Drawing Sheets

WATERPROOF CONNECTOR HAVING INTERNALLY CONCEALED GROUNDING PIN

FIELD OF THE INVENTION

The present disclosure generally relates to a connector, more particularly to a waterproof connector having inner grounding pin fully concealed inside the connector.

BACKGROUND OF THE INVENTION

In each of electronic systems, a connector is functioned as a basic element which is necessary for forming an integral system and performs electrical connection and signal transmission between devices, between elements, or between systems. Therefore, in order to be more competitive in market, all manufacturers make efforts in discrete design or optimization for a detail structure of each of components of the connector, to increase flexibility of modularization of each of components and meet the demand for function and structure of the connector. Generally speaking, most of the existing connectors are fastened on the circuit board by soldering, to transmit electric power or digital data with circuits on the circuit board. Because of different usage demands and environments for various electronic devices, the manufacturers also develop various types of the connectors which are adapted for the electronic devices having specific demands. For example, a waterproof connector is a kind of connector to mainly protect the circuit board from being penetrated by outside moisture to impair a normal operation of the circuit board.

An illustration for the existing waterproof connector is described in following paragraph. Please refer to FIG. 1 and FIG. 2. It is particularly noted that a front direction is defined at top-right side of the FIG. 1, a back direction is defined at down-left side of the FIG. 1, a right direction is defined at down-right side of the FIG. 1 and a left direction is defined at top-left side of the FIG. 1 for convenient illustration. The waterproof connector 1 includes an outer housing 11, an inner casing 12, a terminal block 13 and a waterproof glue layer 14. A front end and a rear end of the outer housing 11 are communicated with each other to form a first accommodating space 110. The inner casing 12 can be mounted into the first accommodating space 110 via a rear end of the outer housing 11 to be assembled inside the outer housing 11. A front end and a rear end of the inner casing 12 are communicated with each other to form a second accommodating space 120. The inner casing 12 is further provided with two grounding pins 121 protrudingly disposed at the rear end thereof. When the inner casing 12 and the outer housing 11 are assembled, the grounding pins 121 are extended out of the rear end of the outer housing 11.

Please refer back to FIG. 1 and FIG. 2. The terminal block 13 is made of isolation material and provided with a plurality of through holes 130 at a rear end thereof and a tongue plate 131 protrudingly disposed at a front end thereof. The tongue plate 131 is provided with a plurality of slots 132 concavely disposed thereon. The slots 132 are communicated with the through holes 130, respectively. The terminal block 13 can be mounted into the second accommodating space 120 via the rear end of the inner casing 12 to be assembled inside the inner casing 12, a plurality of connection terminals 16 are inserted into the terminal block 13 via the through holes 130 respectively, front ends of the plurality of connection terminals 16 are accommodated in the slots 132 respectively, and rear ends of the plurality of connection terminals 16 are exposed out of the rear ends of the terminal block 13 and the inner casing 12. Moreover, after the outer housing 11, the inner casing 12 and the terminal block 13 are assembled integratedly, the manufacturer watertightly fills the waterproof glue layer 14 (as shown in FIG. 2) in the rear ends of the outer housing 11, the inner casing 12 and the terminal block 13, to prevent moisture which is entered via the front ends of the outer housing 11 and the inner casing 12 from leaking out of the rear ends of the outer housing 11 and the inner casing 12. Therefore, the moisture can be efficiently prevented from impairing the circuit board at the rear end of the waterproof connector 1 to cause short-circuit or damage of circuits or electric devices on the circuit board and further cause operation failure of the circuit board.

Please refer back to FIG. 1 and FIG. 2. The grounding pins 121 of the inner casing 12 is penetrated the outer housing 11 and the waterproof glue layer 14 and exposed out of the outer housing 11 and the waterproof glue layer 14, whereby the manufacturer can solder the grounding pins 121. However, during the soldering process, because the grounding pins 121 have larger volume, the manufacturer needs spend more time for heating. The grounding pins made of metal material have better thermal conductivity, so watertightness of the waterproof glue layer 14 near the grounding pins 121 is impaired due to thermal expansion and contraction, and it causes that the waterproof glue layer 14 is hard to efficiently block moisture. Therefore, what is needed is to improve the traditional waterproof connector for solving above-mentioned problems.

SUMMARY OF THE INVENTION

In order to solve the problems that leaking crack may be generated between the waterproof glue layer and the grounding pin of the traditional waterproof connector during the process of soldering the grounding pins, the inventor designs a waterproof connector having internally concealed grounding pin based on long-term practice experience, experiments and tests.

A first objective of the present disclosure is to provide a waterproof connector having internally concealed grounding pin. The waterproof connector is applied to an electronic device for solving the problem that the watertight effect is impaired due to the thermal expansion and contraction of the waterproof glue layer during the process of soldering the grounding pins by the manufacturer. The waterproof connector includes an outer housing, an inner casing, a terminal block and a waterproof glue layer. The outer housing is formed by a metal frame and an isolation layer, the isolation layer is covered on an outer edge and an inner edge of the metal frame by injection molding. A front end and a rear end of the outer housing are communicated with each other to form a first accommodating space inside, and a part of the inner edge of the metal frame is exposed to the first accommodating space to form at least one grounding part. The metal frame is provided with at least one outer grounding pin protrudingly disposed at an outer edge thereof, and the at least one outer grounding pin is penetrated the isolation layer and exposed out of the isolation layer. The inner casing is made of metal material, and a front end and a rear end of the inner casing are communicated with each other to form a second accommodating space inside. The inner casing is provided with at least one inner grounding pin protrudingly disposed at a periphery of a rear end thereof. When the inner casing is mounted into the first accommodating space via the rear end of the outer housing to be assembled inside the outer housing, the inner grounding pin is abutted against the grounding part. The terminal block is formed by plastic integrally and provided with a tongue plate protrudingly disposed at a front end thereof and the tongue plate is provided with a plurality of connection terminals fixedly disposed therein. Ends of the plurality of connection terminals are exposed on a surface of the tongue plate, and other ends of the plurality of connection terminals extended out of the rear end of the terminal block. The terminal block is mounted into the second accommodating space via the rear end of the inner casing to be assembled inside the inner casing. Moreover, the waterproof glue layer is watertightly filled in the rear ends of the outer housing and the inner casing in a condition that the inner casing and the terminal block are assembled inside the outer housing. Therefore, moisture entered via the front ends of the outer housing and the inner casing is hard to leak out of the rear ends of the outer housing and the inner casing.

A second objective of the present disclosure is that the inner grounding pin of the waterproof connector are completely concealed inside the outer housing and not penetrated the outer housing and the waterproof glue layer. Therefore, the manufacturers need not solder the inner grounding pin, so the problem that leaking cracks are generated between the traditional outer housing and the traditional waterproof glue layer after being cooled because of the waterproof glue layer near the traditional inner grounding pin hard to watertightly attached with the traditional inner grounding pin due to effect of thermal expansion and contraction during the process of soldering the inner grounding pins penetrated the outer housing and the waterproof glue layer, can be efficiently solved.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
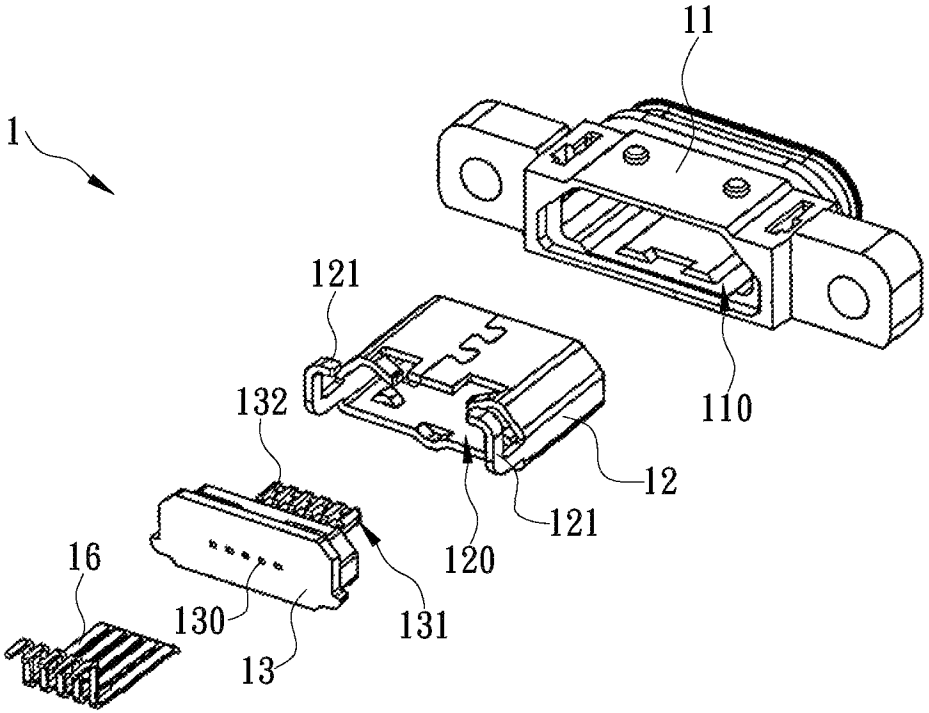
FIG. 1(Prior Art)
FIG. 1 is an exploded perspective view of a traditional waterproof connector.
Figure 2:
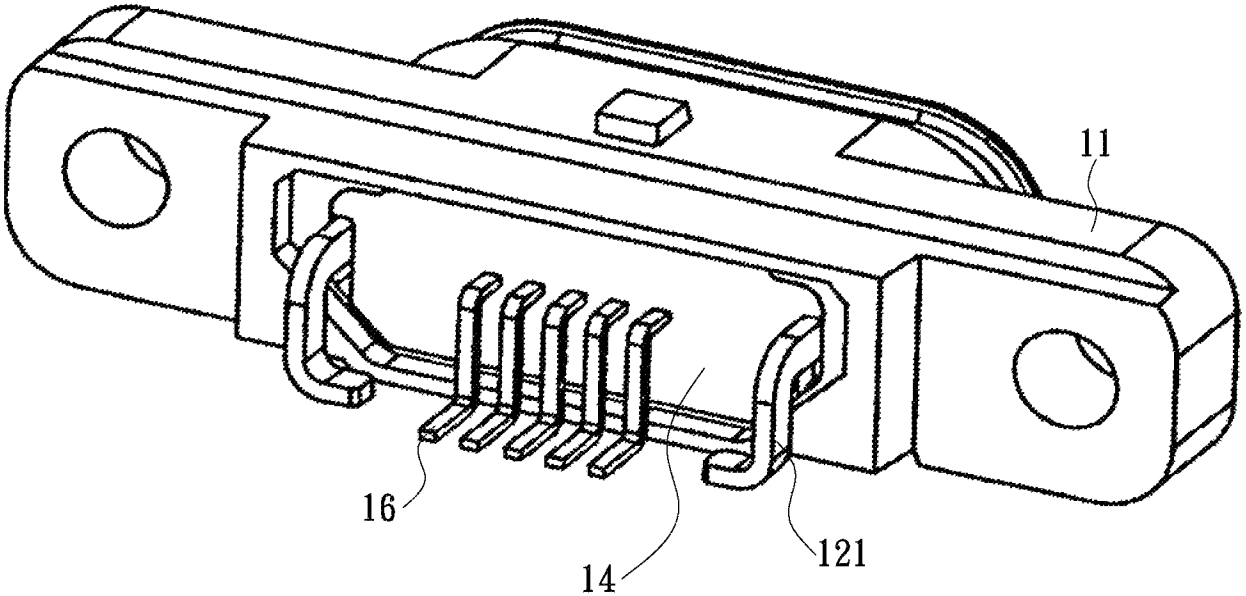
FIG. 2(Prior Art)
FIG. 2 is a rear view of the traditional waterproof connector.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a waterproof connector having internally concealed grounding pin, and the waterproof connector is adapted for electronic apparatus. Please refer to FIG. 3 and FIG. 4 which show an embodiment of the present disclosure. The waterproof connector 2 includes an outer housing 21, an inner casing 23, a terminal block 25 and a waterproof glue layer 27. The outer housing 21 is formed by integrating a metal frame 211 (such as FIG. 4) and an isolation layer 213 which is indicated as points in FIG. 4 for convenient illustration. In the embodiment, a front end and a rear end of the metal frame 211 are communicated with each other and the metal frame 211 is provided with outer grounding pins 215 protrudingly disposed at outer edges of two sides thereof respectively. The outer grounding pins 215 and the metal frame 211 are made integrally. However, it should be noted that in other embodiment of the present disclosure the manufacturer can provide the metal frame 211 having single outer grounding pin 215 or having three or more outer grounding pins 215, upon different usage demand; or the metal frame 211 and the outer grounding pin 215 are two discrete elements and assembled integratedly later.

Figure 3:
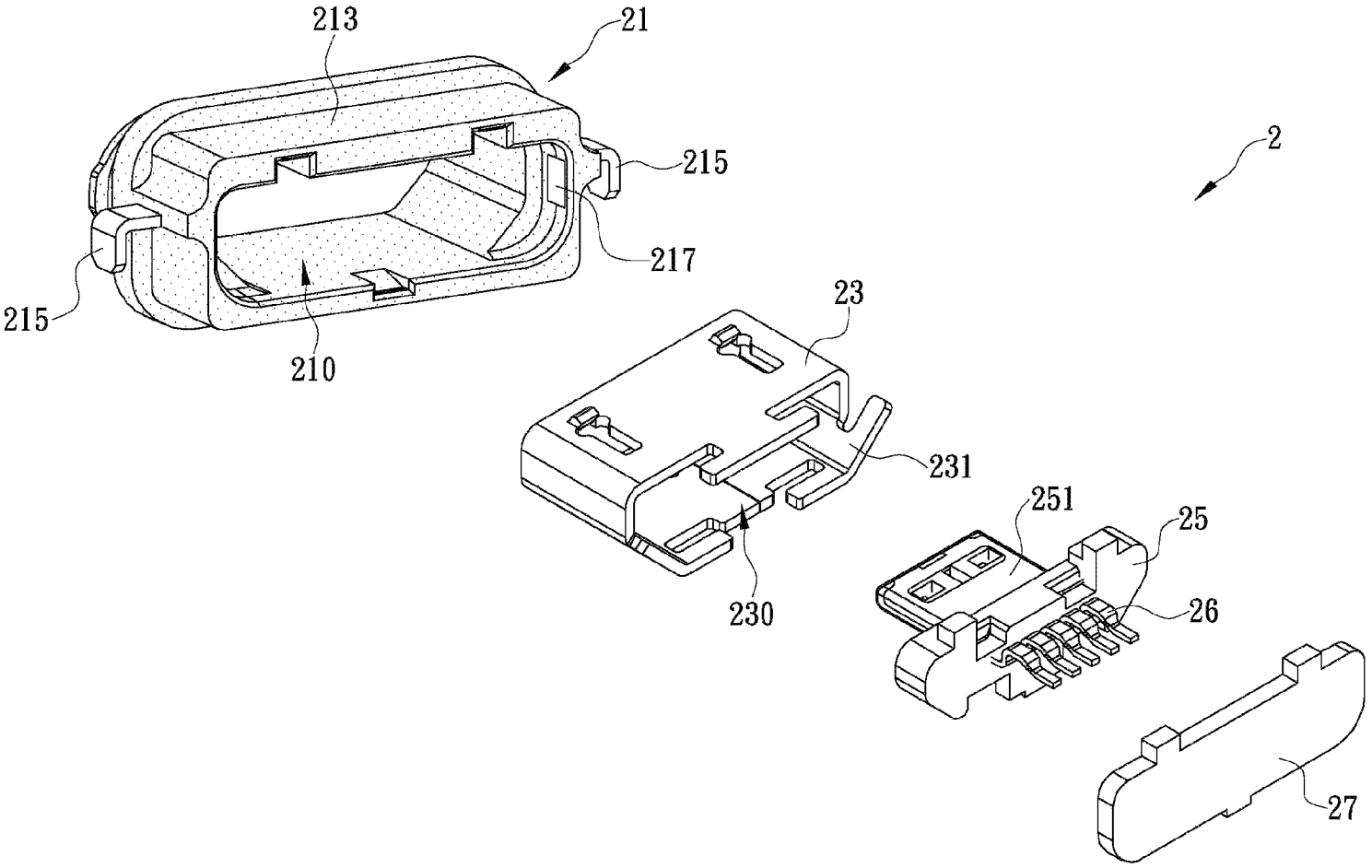
FIG. 3 is an exploded perspective view of a waterproof connector of the present disclosure.
Figure 4:
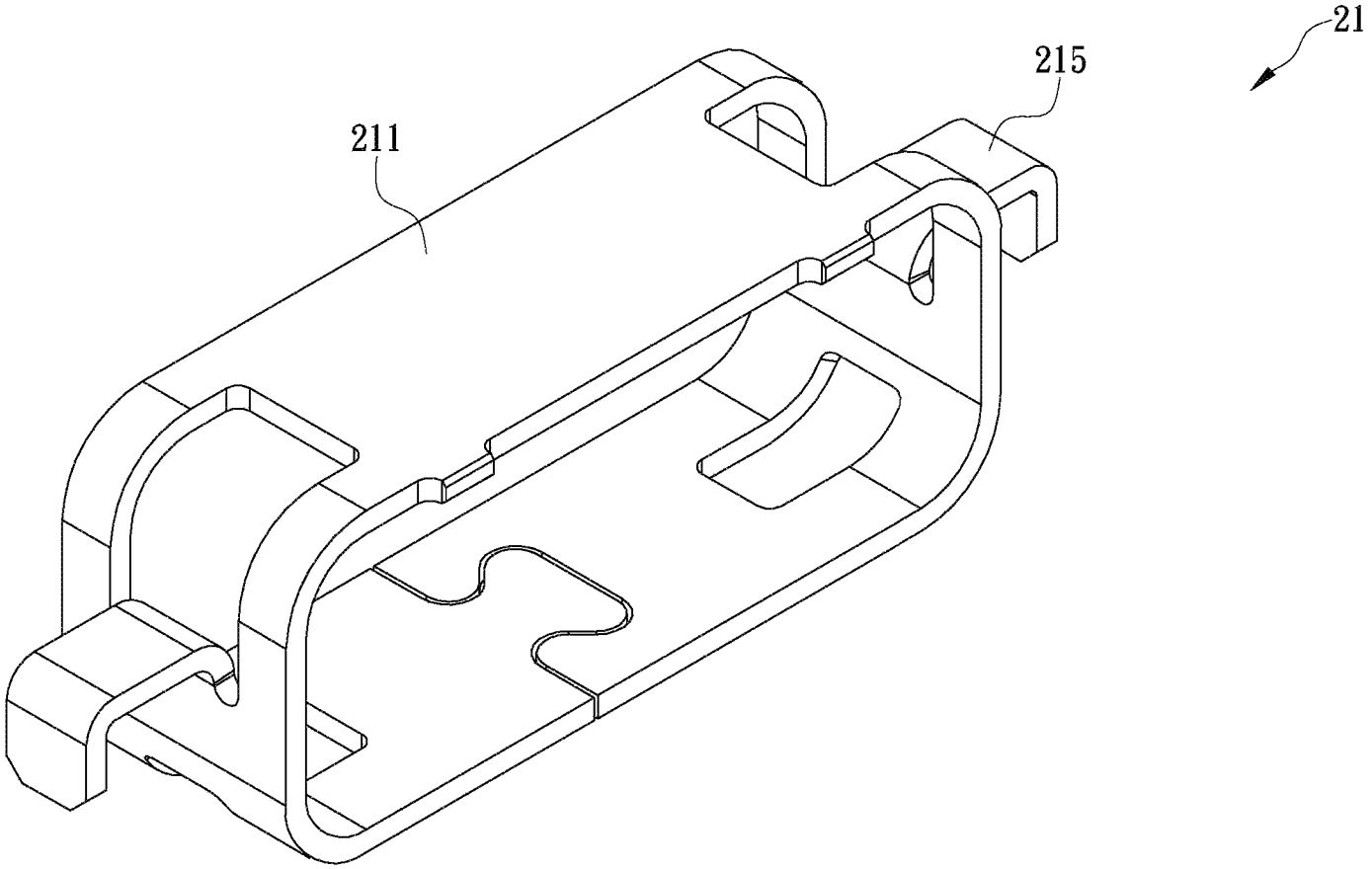
FIG. 4 is a schematic view of a metal frame of the present disclosure.

Moreover, please refer back to FIG. 3 and FIG. 4. The isolation layer 213 is covered on an outer edge and an inner edge of the metal frame 211 by injection molding, so as to enclose the metal frame 211. The front end and the rear end of the outer housing 21 are communicated with each other to form a first accommodating space 210 inside. The outer grounding pins 215 is penetrated the isolation layer 213 and exposed out of the isolation layer 213. A part of the inner edge of the metal frame 211 is exposed in the first accommodating space 210 to form two grounding parts 217 corresponding to each other (just one grounding part 217 is shown in FIG. 3). However, in practical production, a number of the grounding part 217 can be one or more than three, and shape, position or area of the grounding part 217 can be changed upon usage demand, and not limited to the form shown in FIG. 1.

Figure 5:
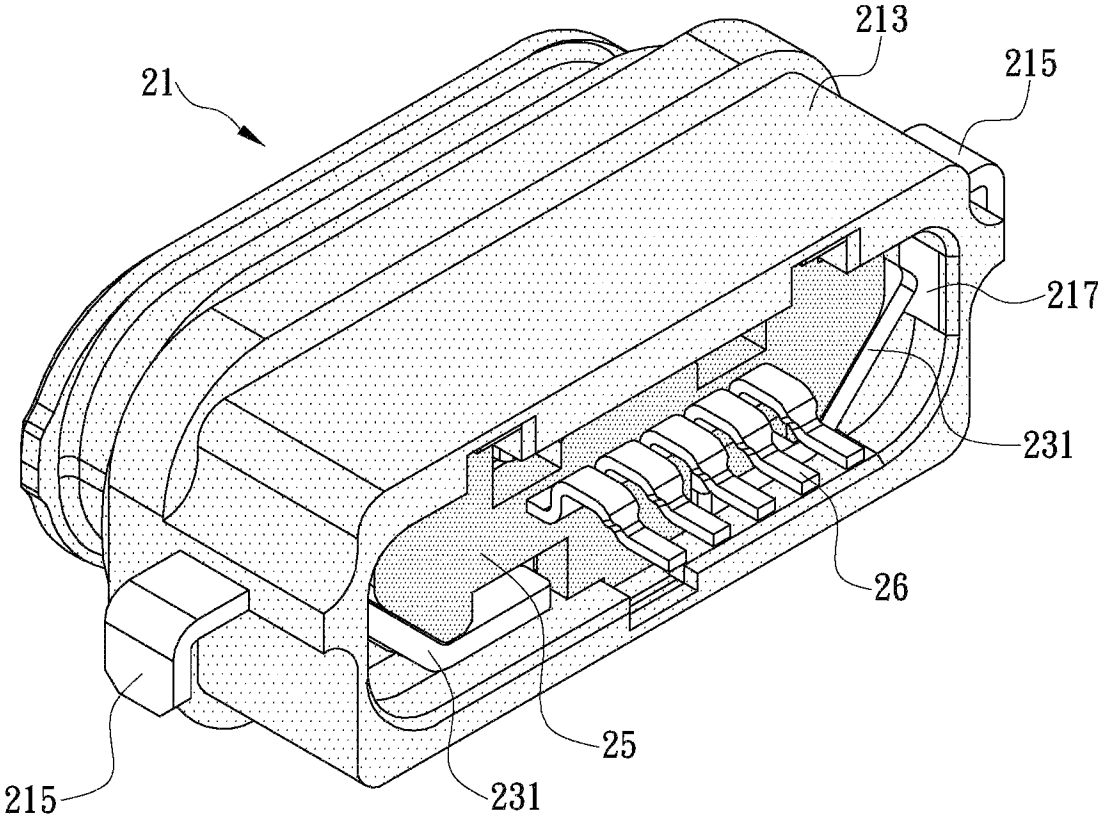
FIG. 5 is a rear view of the waterproof connector without a waterproof glue layer of the present disclosure.

Please refer to FIG. 3 and FIG. 5. The inner casing 23 is made of metal material, and a front end and a rear end of the inner casing 23 are communicated with each other to form a second accommodating space 230 inside. In this embodiment, the inner casing 23 is provided with two inner grounding pins 231 protrudingly disposed at a periphery of the rear end of the inner casing 23, and the inner grounding pins 231 and the inner casing 23 are made integrally. However, it should be noted that in other embodiment of the present disclosure the manufacturer can provide the inner casing 23 having single inner grounding pin 231 or having three or more inner grounding pins 231 upon different usage demand; or the inner casing 23 and the inner grounding pin 231 are two discrete elements and assembled integratedly later. Moreover, the inner casing 23 can be mounted to the first accommodating space 210 via the rear end of the outer housing 21, and be assembled with the outer housing 21 integratedly. In addition, inner grounding pins 231 are respectively abutted against the grounding parts 217 corresponding thereto, as shown in FIG. 5, so that the inner grounding pins 231, the grounding part 217 and the outer grounding pin 215 can form an electrically conductive path.

Figure 6:
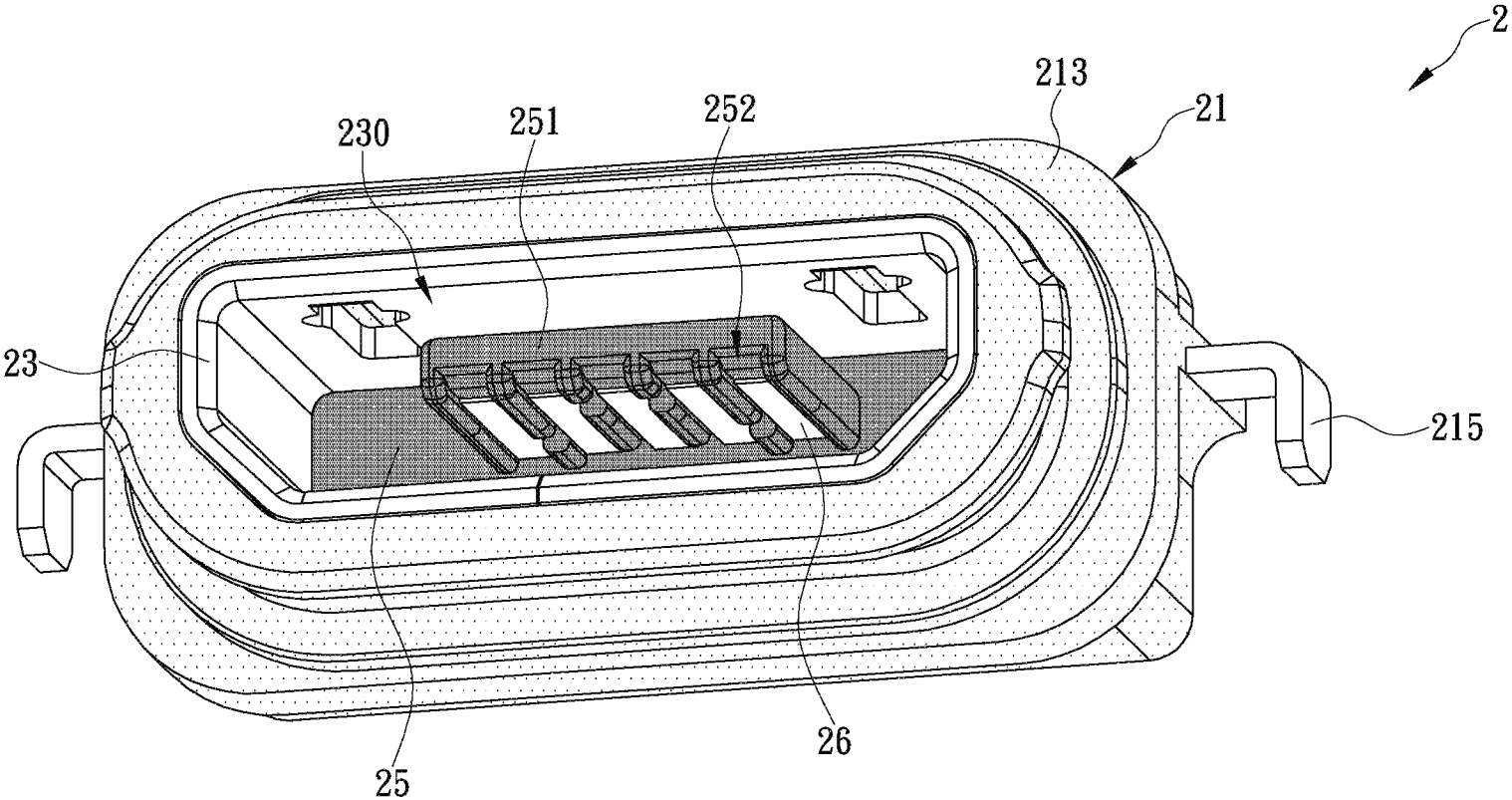
FIG. 6 is a front view of the waterproof connector of the present disclosure.
Figure 7:
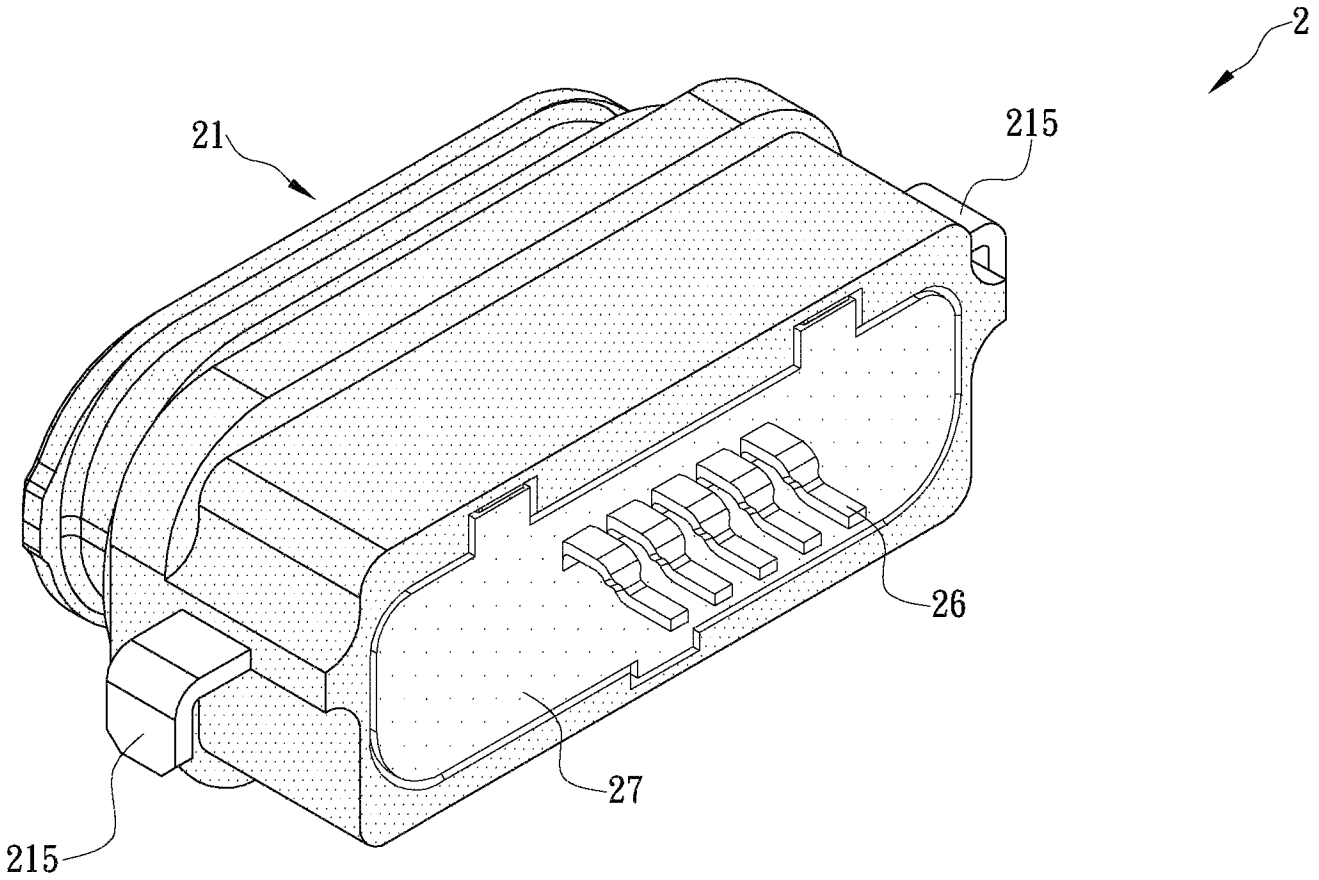
FIG. 7 is a rear view of the waterproof connector of the present disclosure.

Please refer to FIG. 3 and FIG. 6. The terminal block 25 is made of plastic integrally and provided with a tongue plate 251 protrudingly disposed at a front end thereof. The tongue plate 251 is provided with a plurality of slots 252 concavely disposed at a surface thereof. Moreover, a plurality of connection terminals 26 are fixedly disposed on the terminal block 25 and not contacted with each other. Ends of the connection terminals 26 are accommodated into slots 252 respectively and exposed on the surface of the tongue plate 251, and other ends of the connection terminals 26 are extended out of the rear end of the terminal block 25. The terminal block 25 can be mounted to the second accommodating space 230 via the rear end of the inner casing 23 to be assembled into the inner casing 23. Please refer to FIG. 7. After the inner casing 23 and the terminal block 25 are assembled into the outer housing 21, the waterproof glue layer 27 is watertightly filled into the rear ends of the outer housing 21 and the inner casing 23 to cover the rear ends of the inner casing 23 and the terminal block 25. Only other ends of the connection terminals 26 can be exposed out. Therefore, the manufacturer can assemble the waterproof connector 2 on a circuit board (not shown in FIGS.), and connect the outer grounding pins 215 to a grounding circuit of the circuit board or the electronic device, so that the inner casing 23 can have grounding function by the inner grounding pins 231.

To sum up, as shown in FIG. 3 through FIG. 7, the inner grounding pins 231 are designed as an internally concealed type and not penetrated the outer housing 21 and the waterproof glue layer 27 completely. The inner grounding pins 231 is completely concealed inside the outer housing 21, and the other ends of the connection terminals 26 are watertightly passed through the waterproof glue layer 27 and exposed out of the waterproof glue layer 27. Therefore, moisture entered via the front ends of the outer housing 21 and the inner casing 23 is hard to leak out of the rear ends of the outer housing 21 and the inner casing 23, and the outside moisture is efficiently prevented from penetrating into the circuit board to impair the normal operation of circuits on the circuit board. In addition, by the design of the waterproof connector 2 of the present disclosure, the manufacturer just needs to solder the outer grounding pin 215 of the outer housing 21, and the grounding function of the inner casing 23 is formed by the inner grounding pins 231 and the grounding part 217 of the outer housing 21. After the watertight filling of waterproof glue layer 27 is completed, the manufacturer needs not solder the inner grounding pins 231 at all. Therefore, the problem that the traditional waterproof connector is hard to be watertightly attached with the inner grounding pin due to thermal expansion and contraction of the waterproof glue layer and thereby leading to leaking cracks generated on the traditional waterproof glue layer after cooling, can be efficiently prevented.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A waterproof connector having internally concealed grounding pin, comprising:

an outer housing, formed by a metal frame and an isolation layer, the isolation layer covered on an outer edge and an inner edge of the metal frame by injection molding, a front end and a rear end of the outer housing communicated with each other to form a first accommodating space inside, a part of the inner edge of the metal frame exposed to the first accommodating space to form at least one grounding part, the metal frame provided with at least one outer grounding pin protrudingly disposed at the outer edge thereof, the at least one outer grounding pin penetrating the isolation layer and exposed out of the isolation layer;

an inner casing, made of metal material, a front end and a rear end of the inner casing communicated with each other to form a second accommodating space inside, the inner casing provided with at least one inner grounding pin protrudingly disposed at a periphery of the rear end thereof, wherein when the inner casing is mounted into the first accommodating space via the rear end of the outer housing and assembled inside the outer housing, the inner grounding pin is abutted against the grounding part;

a terminal block, formed by plastic integrally and provided with a tongue plate protrudingly disposed at a front end thereof, and tongue plate provided with a plurality of connection terminals fixedly disposed therein, ends of the plurality of connection terminals exposed on a surface of the tongue plate and other ends of the plurality of connection terminals extended out of a rear end of the terminal block, wherein the terminal block is mounted into the second accommodating space via the rear end of the inner casing and assembled inside the inner casing; and a waterproof glue layer, watertightly filled in the rear ends of the outer housing and the inner casing in a condition that the inner casing and the terminal block are assembled inside the outer housing, and the plurality of connection terminals watertightly penetrating out of the waterproof glue layer.

2. The waterproof connector as defined in claim 1, wherein the tongue plate is provided with a plurality of slots concavely disposed on a surface thereof, the ends of the connection terminals are accommodated into the plurality of slots, respectively.

3. The waterproof connector according to claim 2, wherein each of the at least one outer grounding pin is made integrally with the metal frame.

4. The waterproof connector according to claim 2, wherein each of the at least one outer grounding pin and the metal frame are discrete elements and assembled integratedly with each other.

5. The waterproof connector according to claim 3, wherein each of the at least one inner grounding pin is made integrally with the inner casing.

6. The waterproof connector according to claim 4, wherein each of the at least one inner grounding pin is made integrally with the inner casing.

7. The waterproof connector according to claim 3, wherein each of the at least one inner grounding pin and the inner casing are discrete elements and assembled integratedly with each other.

8. The waterproof connector according to claim 4, wherein each of the at least one inner grounding pin and the inner casing are discrete elements and assembled integratedly with each other.

* * * * *